US007518300B2

(12) United States Patent
Bosch et al.

(10) Patent No.: US 7,518,300 B2
(45) Date of Patent: Apr. 14, 2009

(54) METHOD AND DEVICE FOR THE GENERATION OF A PLASMA THROUGH ELECTRIC DISCHARGE IN A DISCHARGE SPACE

(75) Inventors: Eric Gerardus Theodoor Bosch, Eindhoven (NL); Jeroen Jonkers, Aachen (DE); Willi Neff, Kelmis (BE); Günther Hans Derra, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 590 days.

(21) Appl. No.: 10/548,243

(22) PCT Filed: Mar. 5, 2004

(86) PCT No.: PCT/IB2004/000611

§ 371 (c)(1),
(2), (4) Date: Sep. 6, 2005

(87) PCT Pub. No.: WO2004/082340

PCT Pub. Date: Sep. 23, 2004

(65) Prior Publication Data

US 2007/0001571 A1 Jan. 4, 2007

(30) Foreign Application Priority Data

Mar. 10, 2003 (DE) ..... 103 10 623

(51) Int. Cl.
*H01J 17/26* (2006.01)

(52) U.S. Cl. ..... 313/231.31; 313/566; 313/574

(58) Field of Classification Search ..... 313/231.31
See application file for complete search history.

(56) References Cited

U.S. PATENT DOCUMENTS 3,891,813 A 6/1975 Yoon et al.

(Continued)

FOREIGN PATENT DOCUMENTS

CH 301203 8/1954

(Continued)

OTHER PUBLICATIONS

Sanochkin Y.: "Thermocapillary Evacuation of Liquid Leaking From a Porous Wall"; Izv. Akad. Nauk SSSR Mekh. Zhidk. Gaza (Russia), Izvestiya Akademii Nauk SSSR, Mekhanika Zhidkostii Gaza, Russia, vol. 27, No. 1, Feb. 1992, pp. 179-182, XP008030598.

(Continued)

*Primary Examiner*—Peter J Macchiarolo
*Assistant Examiner*—Donald L Raleigh

(57) ABSTRACT

The invention relates to a method and a device for the generation of a plasma through electric discharge in a discharge space which contains at least two electrodes, at least one of which is constructed from a matrix material or carrier material, such that an erosion-susceptible region with an evaporation spot is formed at least by the current flow. To present a method or a device for the generation of a plasma by electric discharge, it is suggested that a sacrificial substrate (38) is provided at least at the evaporation spot, the boiling point of said sacrificial suvstrate (38) during discharge operation lying below the melting point of the carrier material (30), such that charge carriers arising in the current flow are mainly generated from the sacrificial substrate (38).

19 Claims, 4 Drawing Sheets

U.S. PATENT DOCUMENTS

| | | | | |
|---|---|---|---|---|
| 5,241,243 | A * | 8/1993 | Cirri | 315/111.21 |
| 5,576,593 | A * | 11/1996 | Schultheiss et al. | 313/231.31 |
| 6,389,106 | B1 * | 5/2002 | Neff et al. | 378/122 |
| 6,894,298 | B2 * | 5/2005 | Ahmad et al. | 250/504 R |
| 6,998,785 | B1 * | 2/2006 | Silfvast et al. | 315/111.71 |

FOREIGN PATENT DOCUMENTS

| | | | |
|---|---|---|---|
| DE | 282561 | | 9/1990 |
| DE | 10139677 | A1 | 10/2002 |
| EP | 1248499 | A1 | 10/2002 |
| GB | 1 557 696 | * | 9/1976 |
| GB | 1557696 | | 12/1979 |
| WO | WO9929145 | A1 | 6/1999 |
| WO | WO0101736 | A1 | 1/2001 |
| WO | WO0195362 | A1 | 12/2001 |
| WO | WO01195362 | A1 | 12/2001 |
| WO | WO0207484 | A2 | 1/2002 |

OTHER PUBLICATIONS

International Search Report of International Publication No. PCT/IB2004/000611 Contained in International Publication No. WO2004082340.

Written Opinion of the International Searching Authority for International Application No. PCT/IB2004/000611.

International Search Report of International Publication No. PCT/IB2004/000611 Contained in International Publication No. WO2004082340, May 26, 2004.

Written Opinion of the International Searching Authority for International Application No. PCT/IB2004/000611, Jun. 11, 2004.

* cited by examiner

METHOD AND DEVICE FOR THE GENERATION OF A PLASMA THROUGH ELECTRIC DISCHARGE IN A DISCHARGE SPACE

The invention relates to a method and a device for the generation of a plasma through electric discharge in a discharge space which contains at least two electrodes, at least one of which is constructed from a matrix material or carrier material, such that an erosion-susceptible region with an evaporation spot is formed at least by the current flow.

A plurality of such methods and devices is known. Thus WO-A-02/07484 discloses a method and a device for the generation of short-wave radiation by means of a plasma based on a gas discharge, wherein besides the two plasma electrodes two further electrodes are used for a pre-ionization. Apart from a complicated and accordingly expensive electronic control system for generating the plasma pinch, the four electrodes are to be additionally provided with cooling liquid for stabilizing the radiation source.

WO-A-01/95362 discloses a further device for generating a high-frequency plasma pinch through electric discharge, wherein an electrode erosion is to be reduced in that electrical energy transmitted in resonance is stored back again between two capacitors by means of an additional magnetic switch that is in a saturated state. Lithium metal is present on or within one of the electrodes in a further embodiment, which lithium is evaporated by short laser radiation pulses of an additional laser device so as to be excited in the plasma pinch for the emission of extreme ultraviolet radiation. The energy of the laser radiation pulse increases the thermal load of the electrode and further reduces its operational life.

Ignitrons, spark paths, triggered vacuum switches, or pseudo-spark plasma switches used as switching elements in high-current pulse arrangements all comprise electrodes which have had an insufficient useful life until now because of strong electrode erosion. The emission of toxic combustion products of the electrode material, the formation of ozone, and/or ecological problems in the disposal of mercury from an ignitron are particularly disadvantageous here for many fields of application.

CH 301203 relates to an ignitron, for example with a sintered molybdenum sponge electrode for absorbing the mercury, which offers a high resistance to a discharge arc arising during switching. This ignitron has only one sponge cathode in this case so as to provide an unchanging spatial relation to the cathode in all conditions of movement and in each and every position of the ignitron with respect to an ignitor. The useful life of the electrode used as the ignitor, however, remains too short because of the erosion caused by the discharge arc.

Special electrode geometries are known from WO-A-99/29145, both for a more effective emission of extreme ultraviolet and soft X-ray radiation and for pseudo-spark switches with repetition rates into the kilohertz range. An additional switching element is used between a capacitor bank and the electrodes in the plasma pinch, which is operated with spontaneous breakdown. The plasma is not in contact with the insulator and should only reduce a wear of the insulators. The device, which is of a comparatively complicated construction, however, fails to protect the electrode surfaces sufficiently against erosion.

As is disclosed in DE-OS 101 39 677, a plasma pinch triggered by hollow cathodes, HCT pinch for short, can be operated on the left-hand branch of the Paschen curve without a switching element and thus renders possible a low-induction, effective coupling of energy. FIG. 1 from this document laid open to public inspection diagrammatically shows the construction of a pseudo-spark plasma switch for generating extreme ultraviolet or soft X-ray radiation.

A hollow cathode (10) and an anode (12) together with the insulators (18) define a discharge space (22). A current pulse generator causes this electrode system to generate a plasma (26) through electric discharge. This current pulse generator is symbolized by a capacitor bank (20). The plasma (26) is ignited along an axis of symmetry (24) defined by openings (14, 16) of the two electrodes (10, 12).

To generate the plasma (26), a suitable discharge gas has previously been introduced into the discharge space (22) at a pressure (p) which typically lies in a range from 1 to 100 Pa. A pulsed current flow of a few tens up to a maximum of 100 kA with pulse durations typically between 10 and a few hundreds ns length brings a pinch plasma to temperatures (T) of a few tens of electron volts and to densities such that the discharge gas used is excited into an efficient emission of radiation (28) in the desired spectral range, through ohmic heating and electromagnetic compression. A low-ohmic channel in the space between the electrodes is generated by charge carriers in the rear space of the hollow cathode (10). Such charge carriers may be generated in various ways. For example, a surface spark trigger, a highly dielectric trigger, a ferroelectric trigger, or the pre-ionization mentioned above are preferred for use in the hollow electrode for the generation of charge carriers such as, for example, electrons. A strong thermal load on the electrodes (10, 12) is caused thereby mainly at the openings (14, 16) owing to the high pulse energies.

It is possible to influence the required ignition voltage and to predetermine the moment of the electric discharge in particular through the use of auxiliary electrodes as known from WO-A-01/01736. Such auxiliary electrodes may alternatively be used for triggering, such that the capacitor bank (20) need not be charged up to the ignition voltage, but to a lower level. This, however, again generates the plasma in the hollow cathode that strongly erodes the electrode surface and disadvantageously shortens electrode life.

The invention accordingly has for its object to provide a method and a device for generating a plasma through electric discharge which result in a substantially longer operational life or to a higher average loading capacity of the electrodes with the use of technically simple means.

According to the invention, this object is achieved in a method of the kind mentioned in the opening paragraph in that a sacrificial substrate is provided at least at the evaporation spot, the boiling point of said substrate during discharge operation lying below the melting point of the carrier material, such that charge carriers arising in the current flow are mainly generated from the sacrificial substrate.

In this manner the low-melting sacrificial substrate is sacrificed to the benefit of the matrix material so as to keep the electrode shape constant.

Since the current flow from an electrode surface into the plasma always also evaporates a portion of the surface material, the electrode shape is usually changed, which has an adverse effect on the efficiency of the plasma formation. The size and position of the plasma are also changed thereby, so that these electrodes become useless for obtaining a reproducible stable plasma. Usual electrodes are made of solid, electrically and thermally well-conducting materials which are suitable for a low-loss current passage into the plasma on the one hand, and on the other hand for a discharge of thermal energy from the plasma.

Preferably, the method is arranged such that the sacrificial substrate is supplied through the electrode to a surface that faces the electric discharge.

The material losses necessary for enabling the current transport are balanced such that the outer shape of the electrode remains intact for a long period. Advantageously, the method is arranged such that the sacrificial substrate has a lower melting point than the electrodes. The liquid sacrificial substrate then acts as a mobile phase which can be transported quickly and effectively onto the surface of an electrode.

In a further embodiment of the invention, the method is advantageously arranged such that the surface is wetted by the sacrificial substrate. This prevents a direct contact between the plasma and a matrix that defines the outer shape of the electrode. The surface facing the electric discharge is continuously renewed by the transport of the sacrificial substrate induced by capillary forces.

A particularly advantageous embodiment of the invention is obtained when the discharge is operated at an average temperature of the electrode that lies above the melting point of the sacrificial substrate. This average temperature then always lies below the melting point of the carrier material that defines the outer shape of the electrode. A thermal load on the electrode is caused by an emission of radiation and hot particles such as, for example, ions from the plasma or a pulsatory energy of up to several tens J in an electric discharge. This is insufficient for a thermally induced emission of electrons in sufficient quantities. On the surface of an electrode, preferably a cathode, the known process of local overheating or spot formation accordingly takes place, whereby electrode material is evaporated. The evaporating electrode material then usually provides the charge carriers, for example electrons, necessary for the discharge to the plasma. The sacrificial substrate wetting the surface of the electrode evaporates when its boiling point is exceeded, limits the erosion of the carrier material of the electrode, and in addition favors the spot formation in the evolving vapor.

Preferably, the method of generating a plasma through electric discharge is arranged such that the mass of the sacrificial substrate evaporated by the discharge is supplemented from a reservoir. Losses occurring at the surface of an electrode owing to the wetting sacrificial substrate are made good automatically through supplementation of sacrificial substrate by capillary forces. The carrier material here operates like a wet sponge.

In a further embodiment of the invention it is provided that the evaporated sacrificial substrate is returned into a or the reservoir after condensation. The sacrificial substrate wetting the matrix of the carrier material can flow off immediately, so that the outer shape of the electrode according to the invention remains unchanged afterwards. A pollution of an optical system for, for example, EUV lithography by evaporating sacrificial substrate remains comparatively small, which leads to a higher useful output.

A particularly advantageous method of generating a plasma through electric discharge is arranged such that the electric discharge is operated on the left-hand branch of the Paschen curve at a given gas pressure. The choice of an operating point on the Paschen curve on the left of the minimum renders it possible in particular to increase the radiant efficacy in the desired wavelength range such as, for example, extreme ultraviolet and soft X-ray radiation, and to define the characteristic of a pseudo-spark plasma switch more exactly.

A further advantage of the method may be that a gas is present between the electrodes, which gas comprises at least one component that generates the radiation. Xenon may be used for this, for example. The highly ionized xenon ions formed in the plasma pinch emit radiation at, for example, a wavelength of 13.5 nm. If a partial pressure of the radiation-emitting gas is chosen to be too high in the discharge space, however, the generated radiation will also be absorbed.

To increase the intensity of the generated radiation, the method is preferably arranged such that a main ingredient of the gas is transparent to the emitted radiation. Helium, argon, or nitrogen may be used for this, for example, so as to adjust a gas pressure of typically 1 to 100 Pa in the discharge space, thus defining an operating point on the left-hand branch of the Paschen curve given a suitable electrode geometry.

The quantity of sacrificed material in one pulse in the HCT pinch discharge is lower by orders of magnitude than the gas quantity between the electrodes achieving the gas discharge and contributing to the radiation emission. It is accordingly advantageous that substantially more sacrificial substrate is evaporated through a short-period introduction of additional energy before the discharge at least in that location or those locations where the cathode spots or evaporation areas usually occur, for example by means of a laser pulse or electron beam. An energy of the additional laser pulse of approximately 50 mJ is capable of generating a particle quantity of the sacrificial substrate in a range of $10^{15}$ particles in the form of a vapor. The particle quantity of the sacrificial substrate vapor thus generated then corresponds approximately to that of the discharge gas that is normally used. As a result, the plasma pinch is mainly formed in the vapor, and the properties of the vapor now define the radiation emission while the advantages of the dimensional stability of the electrode carrier or matrix material are retained. Thanks to the energy pulse that frees the vapor between the electrodes, it is possible in certain cases to dispense with an additional gas all together. The electrode system is accordingly initially in a vacuum (for example $10^{-6}$ mbar), i.e. very far to the left on the Paschen curve. It is not until the vapor is evolved that the discharge is generated and forms a pinch in the sacrificial substrate vapor.

The method is preferably arranged such that sacrificial substrates such as tin, indium, gallium, lithium, gold, lanthanum, aluminum, and alloys thereof and/or chemical compounds thereof with other elements are used. The elements mentioned above and their salts, some of which boil at considerably lower temperatures, may be used in particular for generating extreme ultraviolet and/or soft X-ray radiation, and the liquidity range of the sacrificial substrate can be adapted to the matrix material.

According to the invention, furthermore, the object as regards a device of the kind mentioned in the opening paragraph is achieved by an arrangement which supplies a sacrificial substrate at least at the evaporation spot, the boiling point of said sacrificial substrate lying below the melting point of the carrier material during discharge operation, such that charge carriers arising in the case of a flow of current can be generated mainly from the sacrificial substrate.

The electrode of the device according to the invention may be used in principle for any application based on a gas discharge. Its outer shape may also be designed in any manner as desired such as, for example, in the form of a cylinder or a hollow electrode.

A particularly advantageous device is obtained when a plasma can be formed along an axis of symmetry defined by openings in the discharge space formed by at least two electrodes and at least one insulator when a defined ignition voltage is reached. This renders it possible, for example, to generate a HCT pinch plasma with a defined spatial dimension by spontaneous breakdown, at a comparatively large distance to the surface of the discharge space. The thermal load on the electrodes and accordingly the electrode erosion can be kept low thereby.

A further embodiment of the invention provides that the carrier material is porous or has capillary-type channels. The additional sacrificial substrate then exits through the carrier material defining the outer shape of the electrode, preferably at the surface that faces the electric discharge.

The device is preferably designed such that the carrier material is connected to at least one reservoir which contains the sacrificial substrate in liquid and/or gaseous form. The reservoir serves both for supplementing the material losses at the surface of the electrode necessarily following the discharge operation and for receiving sacrificial substrate that has condensed in cooler locations of the surface of the discharge space, such that the outer shape of the electrode is always retained. It is obviously also possible to supply the sacrificial substrate in the solid state to the reservoir and/or the discharge space, for example in the form of a wire.

In the embodiment of the device for generating the plasma as described above, it is useful when the carrier material is made from a refractive material, preferably a metal or a metal alloy, or from a ceramic material. Obviously, the outer shape of the carrier material defining an electrode may be formed from any temperature-resistant material.

A particularly advantageous device for generating a plasma is constructed such that the carrier material on at least one of the surfaces facing the plasma of one of the electrodes has a porous shape which is different from the porous shape of other portions of the carrier material.

This renders it possible for the carrier material on the surface of an electrode to have pores of different size. Suitable manufacturing processes are capable of making pores which compensate for local high losses of sacrificial substrate, for example through absorption of a major quantity of the sacrificial substrate, which high losses occur, for example, along or on the axis of symmetry of the plasma pinch, because this is where exposure to the high current flow is strongest.

It is alternatively possible and advantageous when the pore size within the carrier material is different, for example becomes smaller from the inside towards the surface. The capillary forces then advantageously support the sacrificial substrate transport.

Without imposing any limitation on the general use of the device or the method for the generation of a plasma through electric discharge for applications based on gas discharges, an advantageous use is found in the generation of radiation in the range of extreme ultraviolet and/or soft X-ray radiation, in particular for EUV lithography.

The method and the device may also be used for controlling very high current strengths, in particular for high-power switches.

Further features and advantages of the invention will become apparent from the ensuing description of five embodiments and from the drawings to which reference is made. In the drawings.

Figure 3:
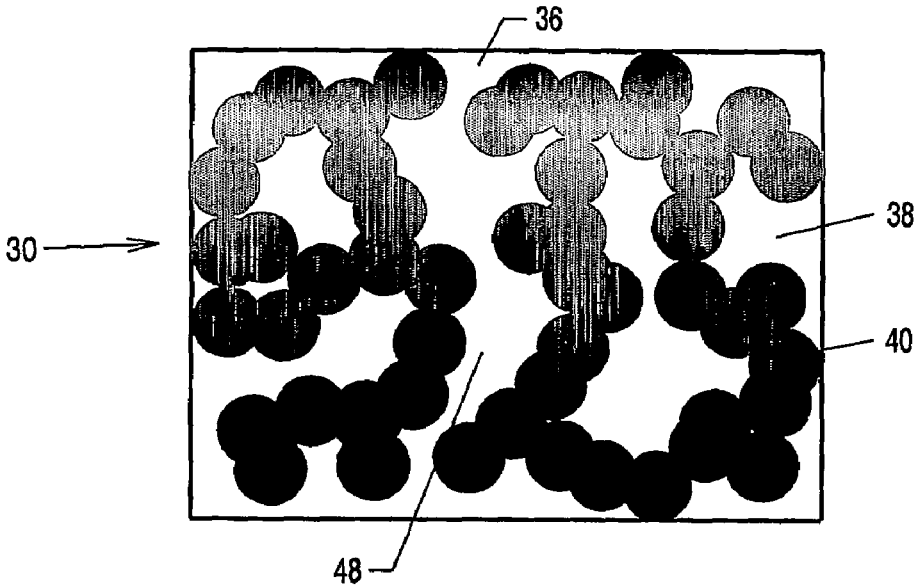
Figure 4:
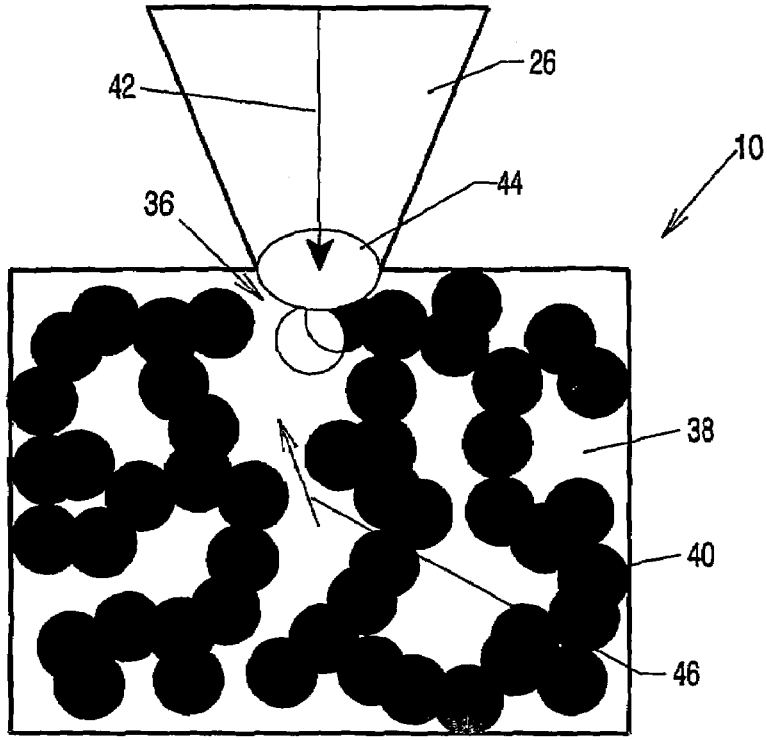
Figure 5:
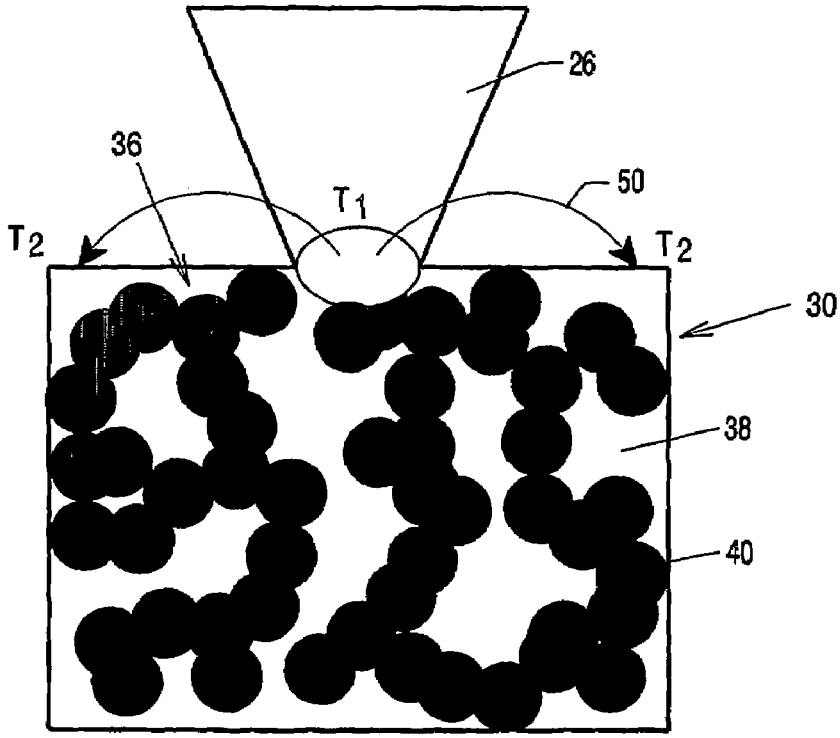
Figure 6:
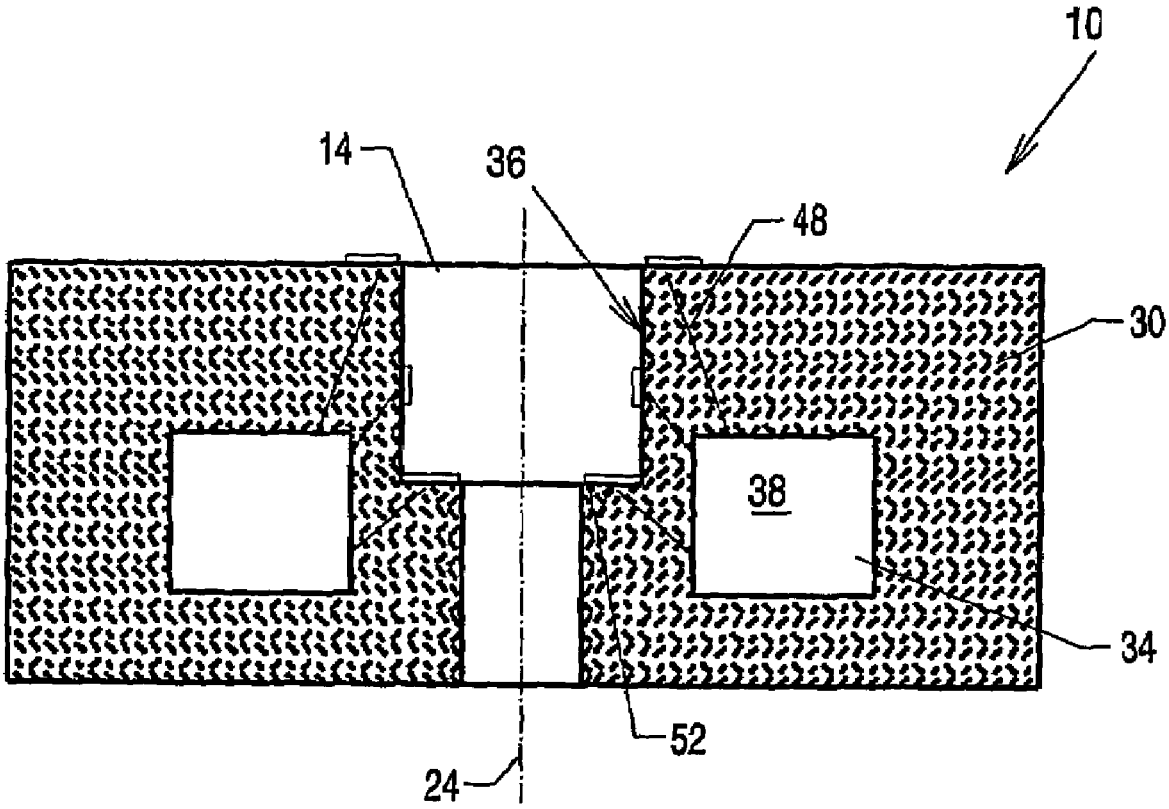

FIG. 3 diagrammatically shows an electrode cross-section in a second embodiment;

FIG. 4 diagrammatically shows an electrode provided with an additional sacrificial substrate during discharge operation in a third embodiment;

FIG. 5 diagrammatically shows an electrode cross-section with an additionally provided sacrificial substrate and an electrode surface temperature distribution during operation of a fourth embodiment; and FIG. 6 diagrammatically shows an electrode geometry with capillary-type channels in a fifth embodiment.

Identical reference symbols always relate to the same constructional features and relate to FIGS. 2 to 6, unless stated to the contrary.

Figure 2:
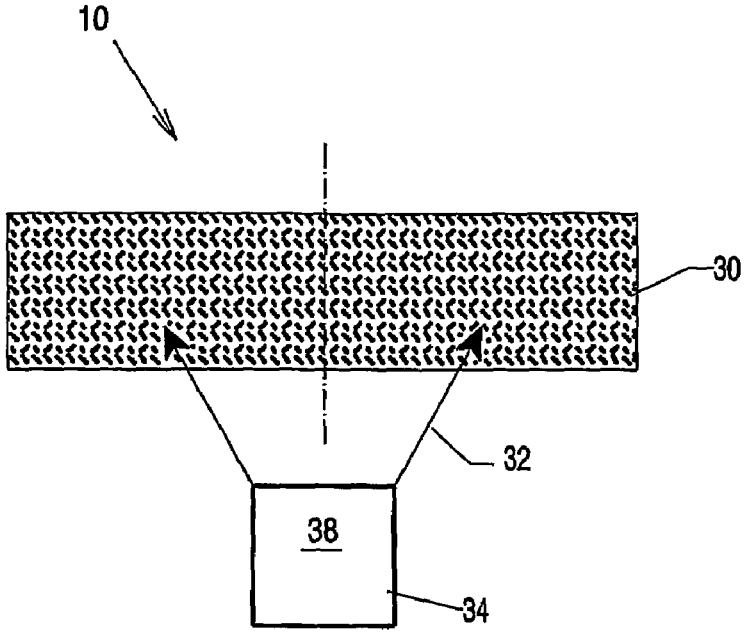
FIG. 2 shows an electrode with a sacrificial substrate that can be additionally supplied in a first embodiment.

The operating principle according to the invention of a first embodiment of a device with a self-regenerating electrode 10 is described in particular with reference to FIG. 2. The electrode 10 is formed from a porous carrier material 30 in whose internal spaces a sacrificial substrate 38 with a lower melting point than the porous carrier material 30 is provided. The sacrificial substrate 38 is present in liquid form in a reservoir 34 and is in communication with a surface 36 (FIG. 3) facing the electric discharge via a passage 32. The liquid sacrificial substrate 38 preferably has the property of wetting the porous carrier material 30.

FIG. 3 shows a second embodiment of a device according to the invention with a renewable electrode 10 in a diagrammatic cross-section. The porous carrier material 30 is constructed as a matrix 40 obtained by sintering of metal bodies, preferably refractive metals such as tungsten or molybdenum. The metal bodies may be varied in shape and size such that a suitable sintering process is capable of generating correspondingly dimensioned pores on the surface 36 or in the intervening spaces and channels 48 in the electrode 10. Obviously, the porous carrier material 30 may alternatively be a ceramic material. The intervening spaces in the matrix 40 are filled with the liquid sacrificial substrate 38 in the electrode 10 according to the invention during operation. The melting and boiling points of the sacrificial substrate 38 are chosen such that they are lower than the melting point of the matrix 40. If the sacrificial substrate 38 wets the matrix 40, naturally occurring capillary forces in the pores exert a suction effect from the reservoir 34 into the porous carrier material 30. This sponge-like property of the porous carrier material 30 leads to a continuous supplementation of the liquid sacrificial substrate 38 into the surface 36 during the discharge operation, thus compensating for the normally occurring detritus of electrode material.

FIG. 4 is a diagrammatic cross-sectional view of a third embodiment of a device in discharge operation. A discharge here heats the surface 36 of an electrode 10 by means of the flow of current 42 so strongly that the liquid sacrificial substrate 38 partly evaporates from the surface 36, thus forming a vapor 44. Since the sacrificial substrate 38 wets the matrix 40, the plasma 26 will come into contact with the sacrificial substrate 38 only. It is not absolutely necessary here for the surface 36 of the electrode 10 to be fully wetted by the sacrificial substrate 38. The sacrificial substrate 38 is capable of taking over the current transport from the electrode 10 also if it is only present in the region of the pores. The sacrificial substrate is then additionally provided to the surface 36 of the electrode 10 through this electrode 10 by a capillary force 46, as required, such that the contour of the matrix 40 and accordingly the outer shape of the electrode 10 remain unchanged.

A fourth embodiment is shown in FIG. 5. The sacrificial substrate 38 evaporates from a surface 36 of a matrix 40 upon ignition of a plasma 26 when a temperature T1 of an electrode spot under formation reaches the boiling point of the sacrificial substrate 38. The supplementary supply of sacrificial substrate 38 limits the thermal load on the matrix 40 to T1, because the energy applied to the surface 36 by the formation of the plasma 26 is removed in the form of evaporation enthalpy of the sacrificial substrate 38. The additionally evaporating sacrificial substrate 38 cools the surfaces 36 slightly during this and forms a vapor 50 which moves in all spatial directions owing to convection. The vapor of the sacrificial substrate 38, however, is capable of condensing for the major portion in the cooler locations of the electrode 10 outside the spot and is returned through the pores to the matrix material 30 again. Cooler regions of the surface 36 lying outside the plasma contact are reached by collisions with the surface 36 in regions having a temperature T2 below the boiling point T1 of the sacrificial substrate 38, which regions absorb the thermal energy stored in the vapor 50. The sacrificial substrate 38 is condensed as a result of this and is returned. This may take place, for example, by means of the capillary forces 46 in the porous carrier material 30 mentioned above. The average operating temperature then always lies above the melting point of the sacrificial substrate 38 and below the melting point of the matrix 40. It is possible by means of an arrangement not shown here, for example by means of a laser pulse or an electron beam, to supply additional energy for a short period before the discharge at least in those locations where cathode spots or evaporation spots usually occur so as to evaporate additional sacrificial substrate 38. The particle mass of the sacrificial substrate 38 thus generated, which may be, for example, tin, indium, gallium, lithium, and alloys and/or chemical compounds with other elements thereof, in this case corresponds approximately to the mass of the discharge gas used for generating EUV and/or soft X-ray radiation.

Figure 1:
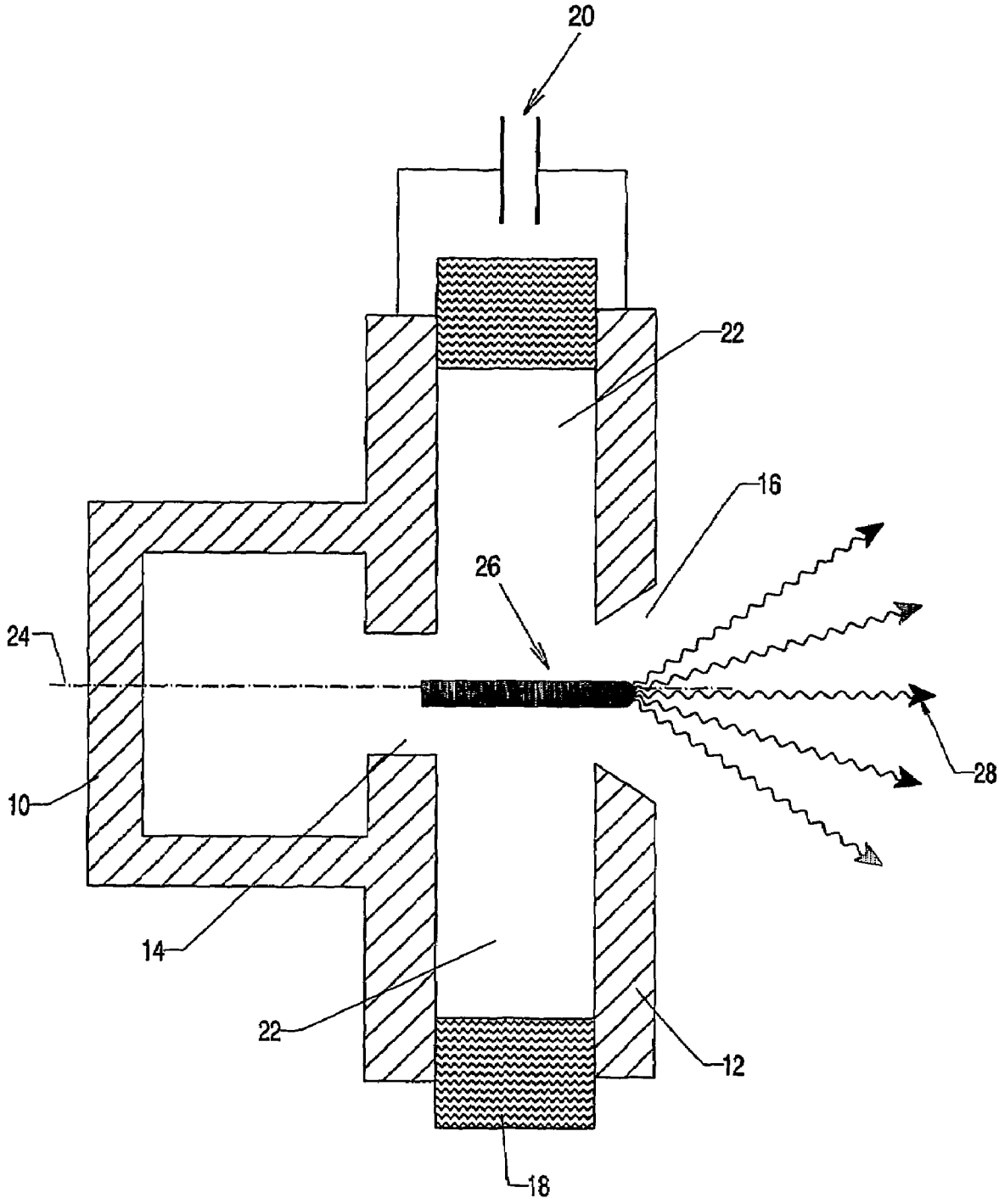
FIG. 1 Prior art
FIG. 1 is a diagram of an electrode geometry according to the prior art.

A particularly advantageous embodiment of a device according to the invention is shown in FIG. 6. In this sixth embodiment, an electrode 10 has a first opening 14 which is coaxial with the axis of symmetry 24 of an electric discharge. The electrode 10 comprises besides a carrier material 30 at least one reservoir 34 which contains a liquid and/or gaseous sacrificial substrate 38, and capillary-type channels 48 extending to the surface 36. The surface tension of the liquid sacrificial substrate 38 issuing from the surface 36 gives rise to planarly bounded regions of a wetted surface 52 which protects the carrier material 30 against erosion in the discharge operation. A suitable arrangement of the capillary-type channels 48 in the carrier material 30 is capable of achieving a suitable supply of sacrificial substrate 38 in accordance with the requirements. The surface 36, and thus the electrode 10, is continuously regenerated. The sacrificial substrate 38 may alternatively be supplied in wire form to the reservoir 34 and/or the surface 36, or the discharge space 22 (shown in FIG. 1, not in FIG. 6), as required.

The invention provides a method and a device for the generation of a plasma through electric discharge which is stable in shape and which may be used in particular as a source of radiation in the range of extreme ultraviolet and/or soft X-ray radiation, or as a pseudo-spark plasma switch.

LIST OF REFERENCE SYMBOLS

10 electrode I
12 electrode II
14 first opening
16 second opening
18 insulator
20 capacitor bank
22 discharge space
24 axis of symmetry
26 plasma
28 radiation
30 carrier material, matrix material
32 feed passage
34 reservoir
36 surface
38 sacrificial substrate
40 matrix
42 current flow
44 substrate vapor
46 capillary force
48 channel
50 vapor
52 wetted surface
p gas pressure
T, T1, T2 temperatures
U ignition voltage

The invention claimed is:

1. A method for the generation of a plasma through electric discharge in a discharge space which contains at least two electrodes, at least one of which is constructed from a matrix material or carrier material, such that an erosion-susceptible region with an evaporation spot is formed at least by the current flow, characterized in that a sacrificial substrate (38) is provided at least at the evaporation spot, the boiling point of said sacrificial substrate (38) during discharge operation lying below the melting point of the carrier material (30), such that charge carriers arising in the current flow are mainly generated from the sacrificial substrate (38).

2. A method as claimed in claim 1, characterized in that the sacrificial substrate (38) is supplied through the electrode (10) to a surface (36) that faces the electric discharge.

3. A method as claimed in claim 1, characterized in that said surface (36) is wetted by the sacrificial substrate (38).

4. A method as claimed in claim 1, characterized in that the discharge is operated at an average temperature (T) of the electrodes (10) that lies above the melting point of the sacrificial substrate (38).

5. A method as claimed in claim 1, characterized in that the mass of the sacrificial substrate (38) evaporated by the discharge is supplemented from a reservoir (34).

6. A method as claimed in claim 1, characterized in that the evaporated sacrificial substrate (38) is returned into a or the reservoir (34) after condensation.

7. A method as claimed in claim 1, characterized in that the electric discharge is operated on the left-hand branch of the Paschen curve at a given gas pressure (p).

8. A method as claimed in claim 1, characterized in that a gas is present between the electrodes (10, 12), which gas comprises at least one component that generates radiation (28).

9. A method as claimed in claim 8, characterized in that a main ingredient of the gas is transparent to the emitted radiation (28).

10. A method as claimed in claim 1, characterized in that substantially more sacrificial substrate is evaporated through a short-period introduction of additional energy before the discharge at least in that location or those locations where the cathode spots or evaporation areas usually occur, for example by means of a laser pulse or electron beam.

11. A method as claimed in claim 1, characterized in that sacrificial substrates (38) such as tin, indium, gallium, lithium, gold, lanthanum, aluminum, and alloys thereof and/or chemical compounds thereof with other elements are used.

12. A device for generating a plasma through electric discharge, comprising a discharge space (22) having at least two electrodes, of which at least one is constructed from a matrix material or carrier material such that an erosion-susceptible region with an evaporation spot is formed at least owing to the flow of current, characterized by an arrangement which supplies a sacrificial substrate (38) at least at the evaporation spot, the boiling point of said sacrificial substrate (38) lying below the melting point of the carrier material (30) during discharge operation, such that charge carriers arising in the case of a flow of current can be generated mainly from the sacrificial substrate (38).

13. A device as claimed in claim 12, characterized in that a plasma (26) can be formed along an axis of symmetry (24) defined by openings (14, 16) in the discharge space, which is formed by at least two electrodes (10, 12) and at least one insulator (18), when a defined ignition voltage is reached.

14. A device as claimed in claim 12, characterized in that the carrier material (30) is porous or has capillary-type channels (48).

15. A device as claimed in claim 12, characterized in that the carrier material (30) is connected to at least one reservoir (34) which contains the sacrificial substrate (38) in liquid and/or gaseous form.

16. A device as claimed in claim 12, characterized in that the carrier material (30) is formed by a refractive material, preferably a metal or a metal alloy, or from a ceramic material.

17. A device as claimed in claim 12, characterized in that the carrier material (30) has a porous shape on at least one of the plasma-facing surfaces of one of the electrodes (10), which shape is different from the porous shape of other portions of the carrier material (30).

18. The use of the method and/or the device for the generation of plasma as claimed in claim 1 for the generation of radiation in the range of extreme ultraviolet and/or soft X-ray radiation, in particular for EUV lithography.

19. The use of the method and/or the device for the generation of plasma (26) as claimed in claim 1 for controlling very high current strengths, in particular for high-power switches.

* * * * *